United States Patent [19]

Chen et al.

[11] Patent Number: 4,919,014

[45] Date of Patent: Apr. 24, 1990

[54] BOTTLE CLOSURE OPENER

[76] Inventors: Joseph Chen; Isabelita H. Chen, both of #4 Lantawan St., Quezon City, Philippines

[21] Appl. No.: 355,284

[22] Filed: May 22, 1989

[30] Foreign Application Priority Data

Jun. 6, 1988 [PH] Philippines ..... 37014

[51] Int. Cl.[5] ..... B67B 7/18

[52] U.S. Cl. ..... 81/3.2; 81/3.32

[58] Field of Search ..... 81/3.2, 3.32, 3.32, 81/3.33; 53/317, 381 A, 381 R

[56] References Cited

U.S. PATENT DOCUMENTS 4,171,650 10/1979 Cardinal ..... 81/3.2

4,762,029 8/1988 Chen ..... 81/3.2

*Primary Examiner*—Roscoe V. Parker

[57] ABSTRACT

The improved bottle closure opener has a housing with an open front having a reawardly disposed front panel with an elongated vertical housing Slit at the mid-section thereof, opposed Side walls with vertical guide grooves on the outer surfaces thereof, a base, and a ceiling case. An L-shape bottle platform formed by a bottle seat and a vertical case is slidably held on the guide grooves of said side walls. A pair of bottle clamps of V-shape formation supported on the bottle seat and secured to respective clamp shafts pivotally move toward or away from each other by means of a bottle clamping mechanism operably held and concealed in the vertical case of said bottle platform. A driving mechanism, disposed and concealed inside the vertical column of the housing. Control switches consisting of an "Up" switch having a screw nut lifter and a "Down" switch, operably connected to a reversible motor, actuate the driving mechanism for an up or down movement of a screw nut with a nut finger to move the bottle clamps towards or away from each other while moving the platform up or down. A bottle cap loosener with suspendedly supported cap loosener blades is driven by a gear train operably connected to the drive mechanism, said cap loosener blades unit being coaxially aligned with the center of the area between the bottle clamps. A safety switch is provided to stop the rotation of the bottle cap loosener when the bottle cap has been loosened.

4 Claims, 8 Drawing Sheets

BOTTLE CLOSURE OPENER

The present invention relates in general to a bottle closure opener. More particularly, it relates to an improved bottle closure opener adapted for use on a jar or bottle with a screw cap.

This application is an improvement of our Philippine application Ser. No. 33719 filed Apr. 30, 1986, now U.S. Pat. No. 4,762,029 issued on Aug. 9, 1988.

In said U.S. Pat., the bottle closure opener although satisfactory in performance, still needs to be improved based on the following observations:

(1) The vertically movable platform which moves either upward or downward along the housing column by means of a reversible motor, a clutch unit, and a helically threaded hollow shaft, stops moving upward or downward when it reaches its upper or lower terminal. If, when the platform reaches its terminal and the motor is still been switched to "ON", the motor can go on turning only when a slip happens between the clutch lining and the clutch plate of the clutch unit. Since a slip creates friction and consumes energy, a clutch lever unit linked to the motor switch is provided in our previous application to manually engage or disengage the clutch unit so that the motor, aside from being used for the bottlemotor, aside from being used for the bottle closure opener, can also be utilized to operate other appliances such as blender, a can opener, and the like. This clutch lever unit is complicated in construction, and the manual operation of the clutch lever needs dexterity and effort.

(2) The actuating mechanism of the bottle body clamping unit on the movable platform is exposedly mounted underneath thereof, thereby limiting the lowermost position of the platform, is messy, and subject to accidental damage.

(3) Even if a bottle has been turned loose, if the motor keeps turning in "up" direction, the bottle cap loosener will continue to turn counterclockwise, causing the bottle cap to rise excessively and creates additional, abnormal stress against the cap loosener, the platform, as well as the glass body of the bottle.

The present invention intends to remedy the above mentioned drawbacks.

The main object of this invention, therefore, is to provide an improved bottle closure opener for a screw-type bottle cap which is very simple, easy and safe to use, and very effective and efficient in performance.

A further object of the present invention is to provide an improved bottle closure opener which is versatile in use as it could be readily adapted to accommodate jars or bottles of various sizes, heights and shapes.

Another important object of the present invention is to provide an improved bottle closure opener which could be used to drive other appliances such as in a blender, a can opener, and the like.

The above objects and advantages of the present invention will be fully appreciated and clearly understood upon the reading of the detailed description taken togewith the accompanying drawings, wherein.

Figure 1:
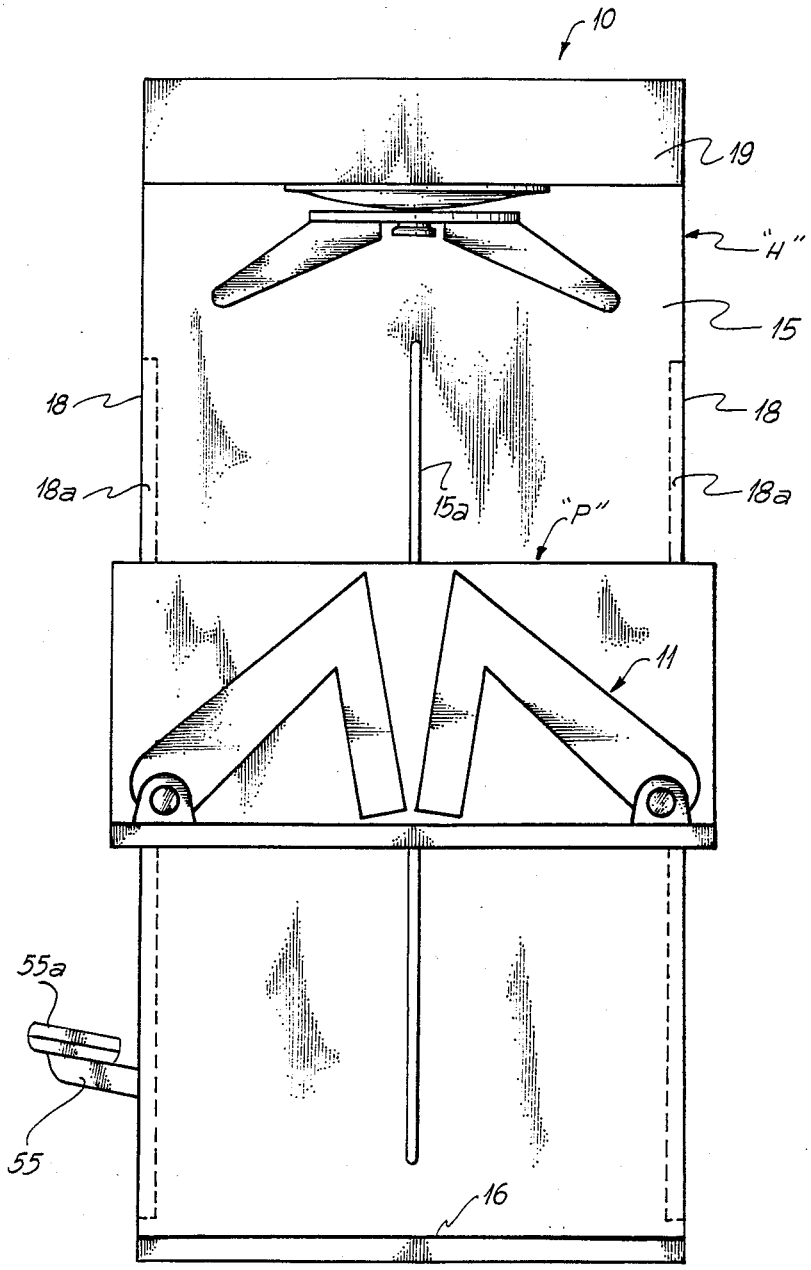
FIG. 1 is a front view of a bottle closure opener for a screw-type bottle cap in accordance with the present invention.
Figure 3:
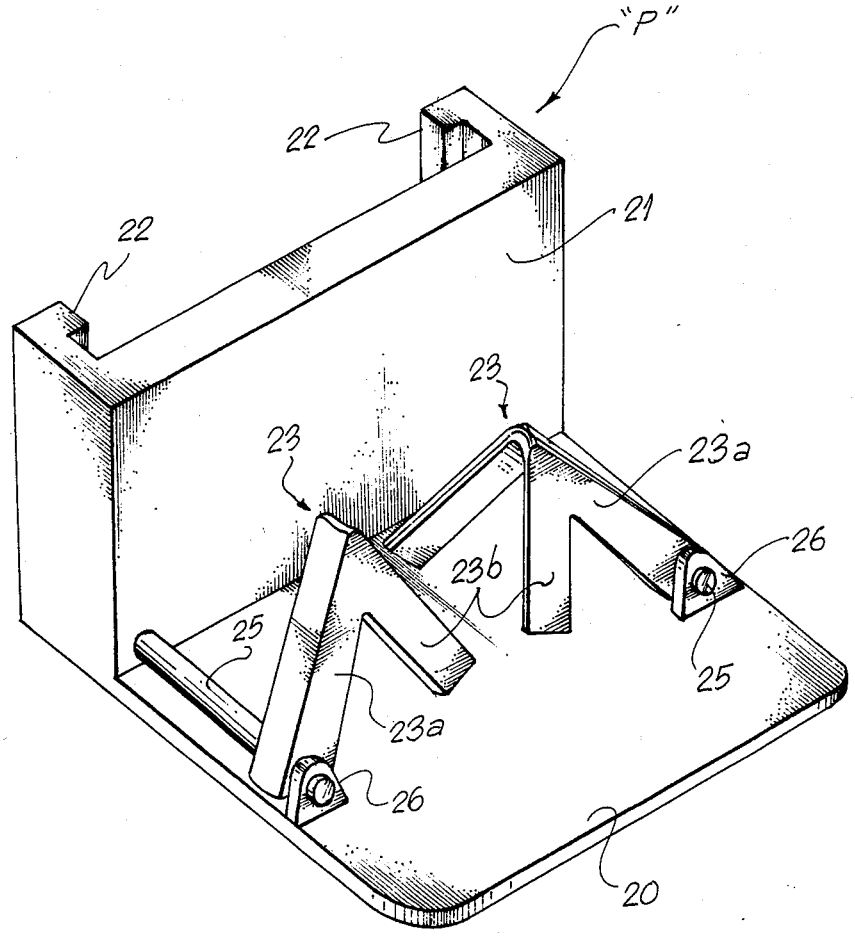
Figure 5:
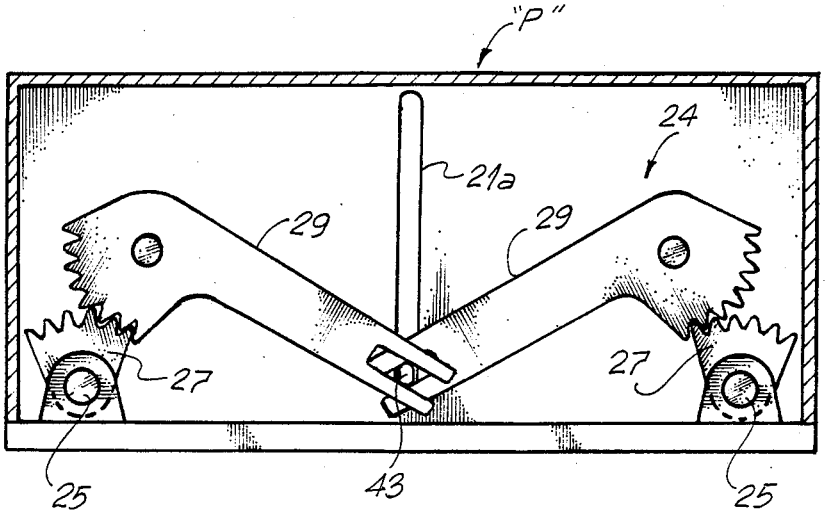
Figure 5A:
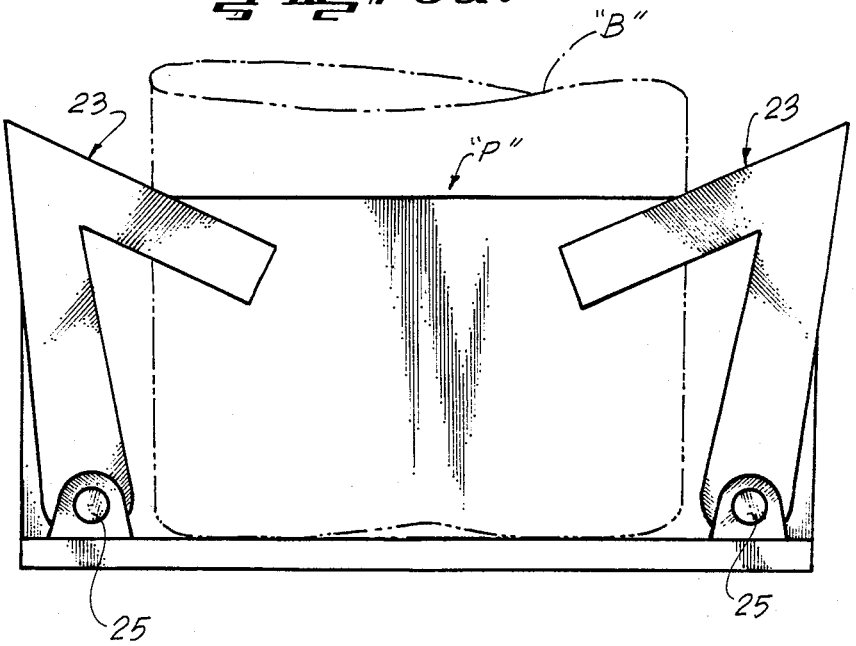
Figure 4C:
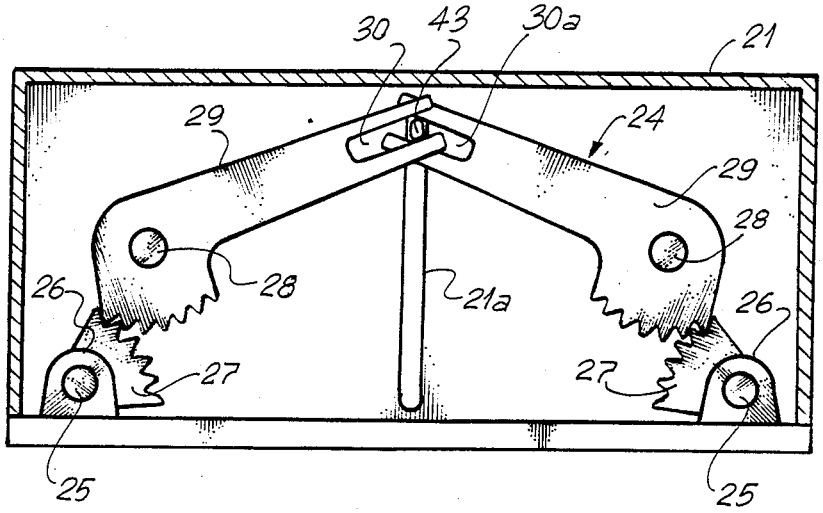
Figure 4A:
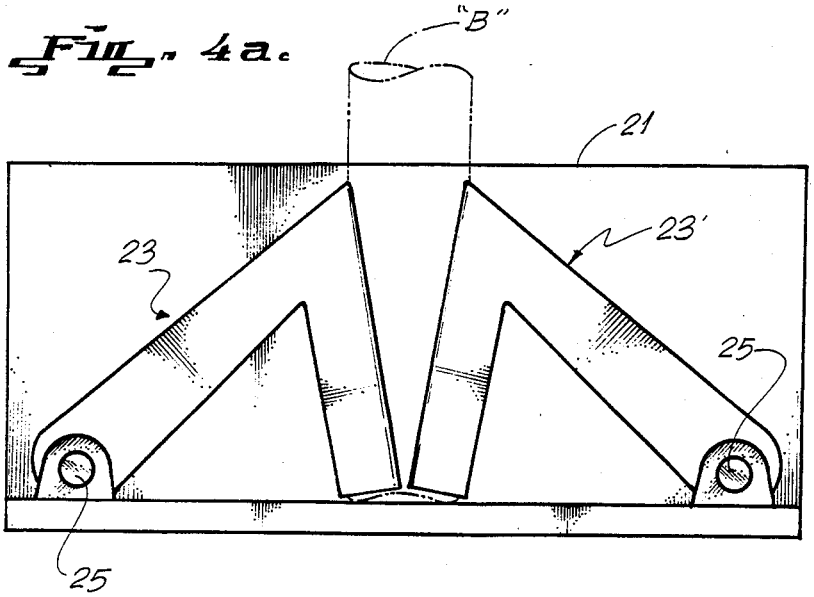
Figure 6:
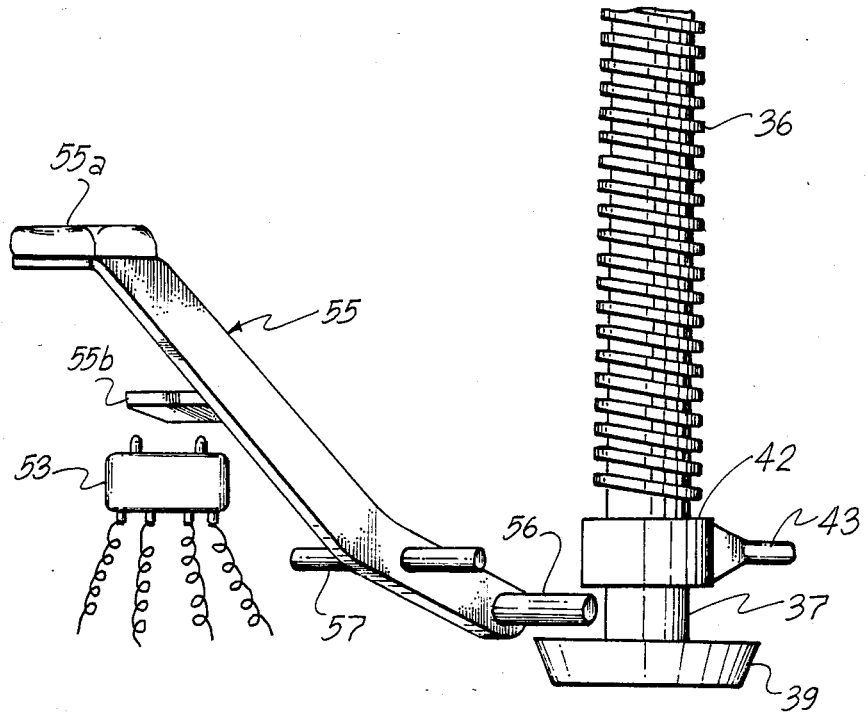

FIG. 3. is a perspective view of the bottle platform for use in FIG. 1;

FIG. 4 is a front view of FIG. 3 with its front wall cut away showing a sector gear type clamping mechanism and illustrating the screw nut finger at its highest position to effect a small-size bottle clamping position;

FIG. 4*a* is a front view of FIG. 1 showing the bottle clamps clamping a small size bottle;

FIG. 5 is a view similar to FIG. 4 showing the sector gear type clamping mechanism at its lowest position to effect large-size bottle clamping position;

FIG. 5*a* is a front view of FIG. 3 showing the bottle clamps clam a large-size bottle;

FIG. 6 a fragmentary perspective view illustrating the nut lifter of the up-switch lever in engaging the screw to the hollow screw shaft.

Figure 7C:
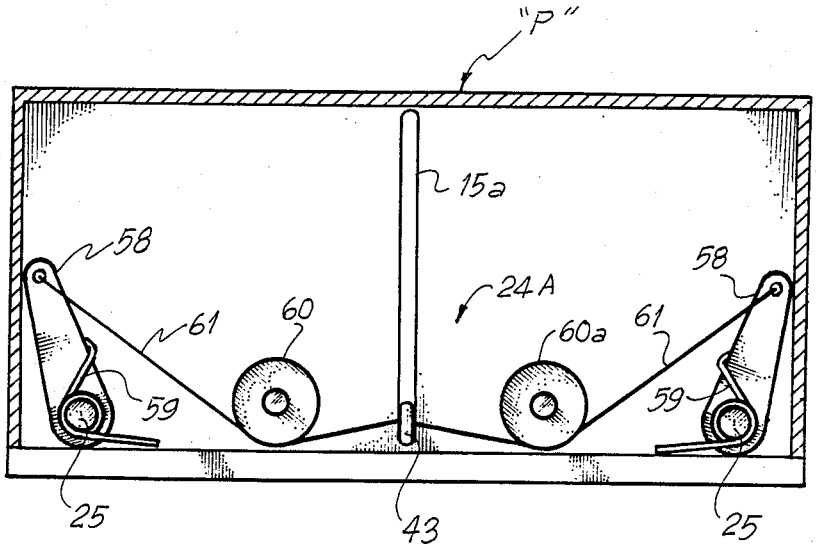
Figure 7A:
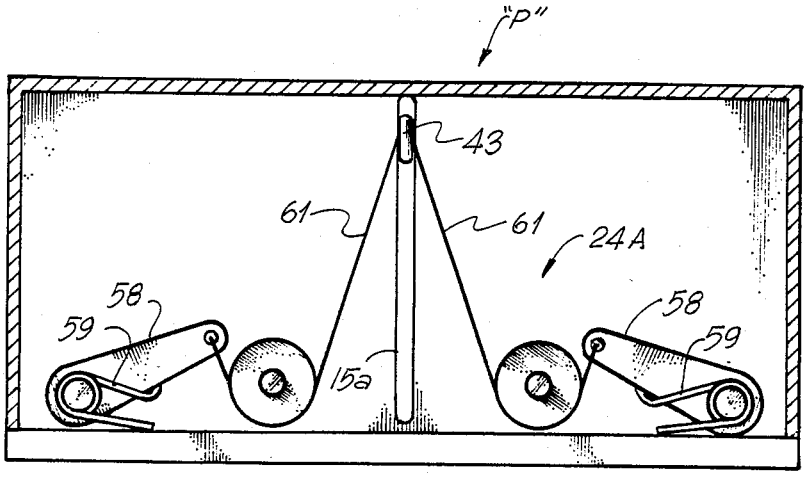
Figure 8C:
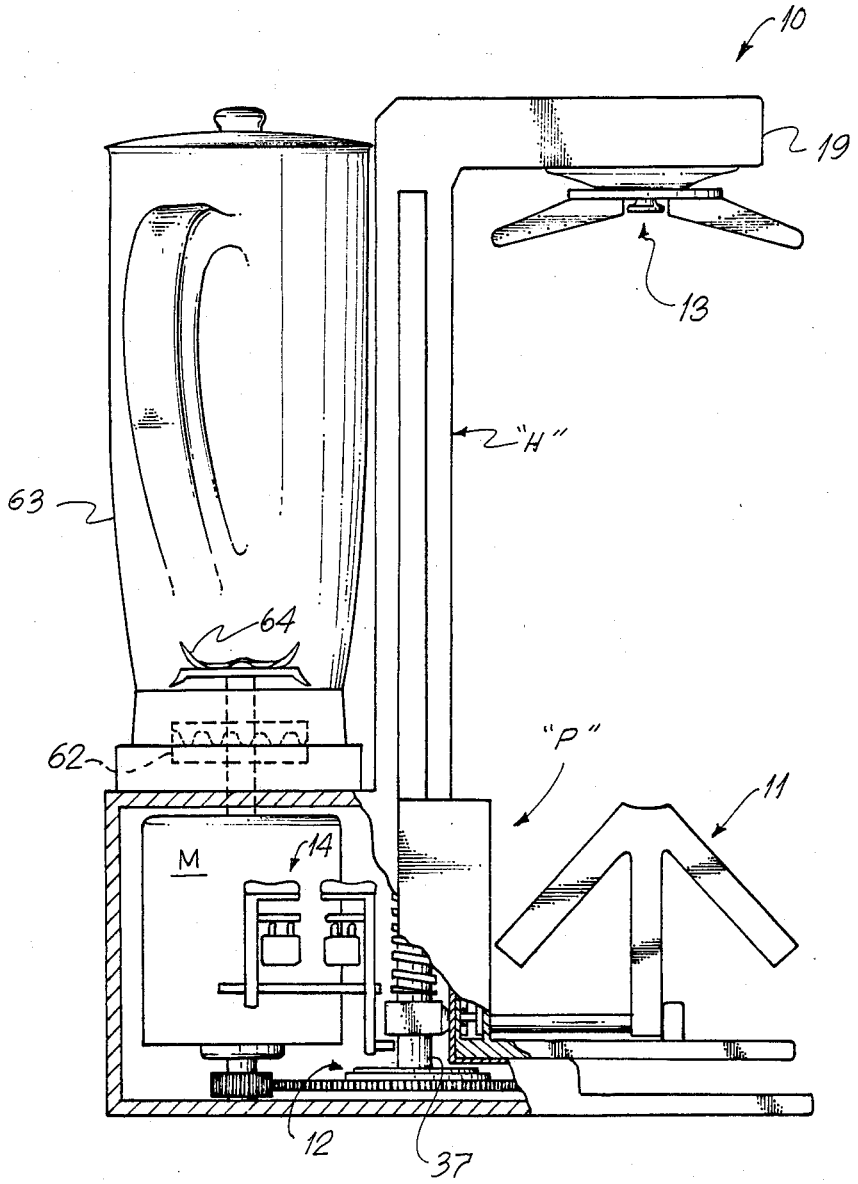

FIG. 7 illustrates another embodiment of a bottle clamping mechanism employing a clamp wire and showing the screw nut finger at its lowest position to effect a wide bottle clamping position;

FIG. 7*a* is a view similar to FIG. 7 showing the screw nut finger at its highest position; and FIG. 8 is a side view of the bottle closure opener with cut-away portions and illustrating its use to drive other appliances such as a blender.

Referring now to the drawings in detail, there is shown in FIG. 1 an improved bottle closure opener indicated in its entirety as 10 adapted to open a screw cap of a bottle or jar of any size, height or shape.

The bottle closure opener 10 includes a housing "H", a vertically slidable bottle platform "P" mounted on said housing, a bottle body clamping unit 11, a driving mechanism 12, a bottle cap loosener unit 13 and control switches 14.

The housing "H" has an open front with a rearwardly disposed front panel 15, said panel being provided with an elongated vertical housing slit 15*a* disposed at the mid section thereof, a base 16, a rear wall 17 having an extended rear portion 17*a*, opposed side walls 18, 18 each provided with guide grooves 18*a*, vertically disposed on the outer surfaces thereof, and a ceiling case 19.

As clearly illustrated in FIG. 3, the bottle platform "P" has an L-shape body formed by a bottle seat 20 and a vertical case 21 having a vertical case slit 21*a* (FIG. 4) disposed at the mid section of the rear wall thereof and aligned with the elongated housing slit 15*a* of the front panel 15. At the outer edges of the vertical case 21 are guide blocks 22, 22 adapted to be slidably held in a snug-fit relation on the guide grooves 18*a*, 18*a* on side Walls 18, 18 to permit an up or down movement of said bottle platform.

Figure 2:
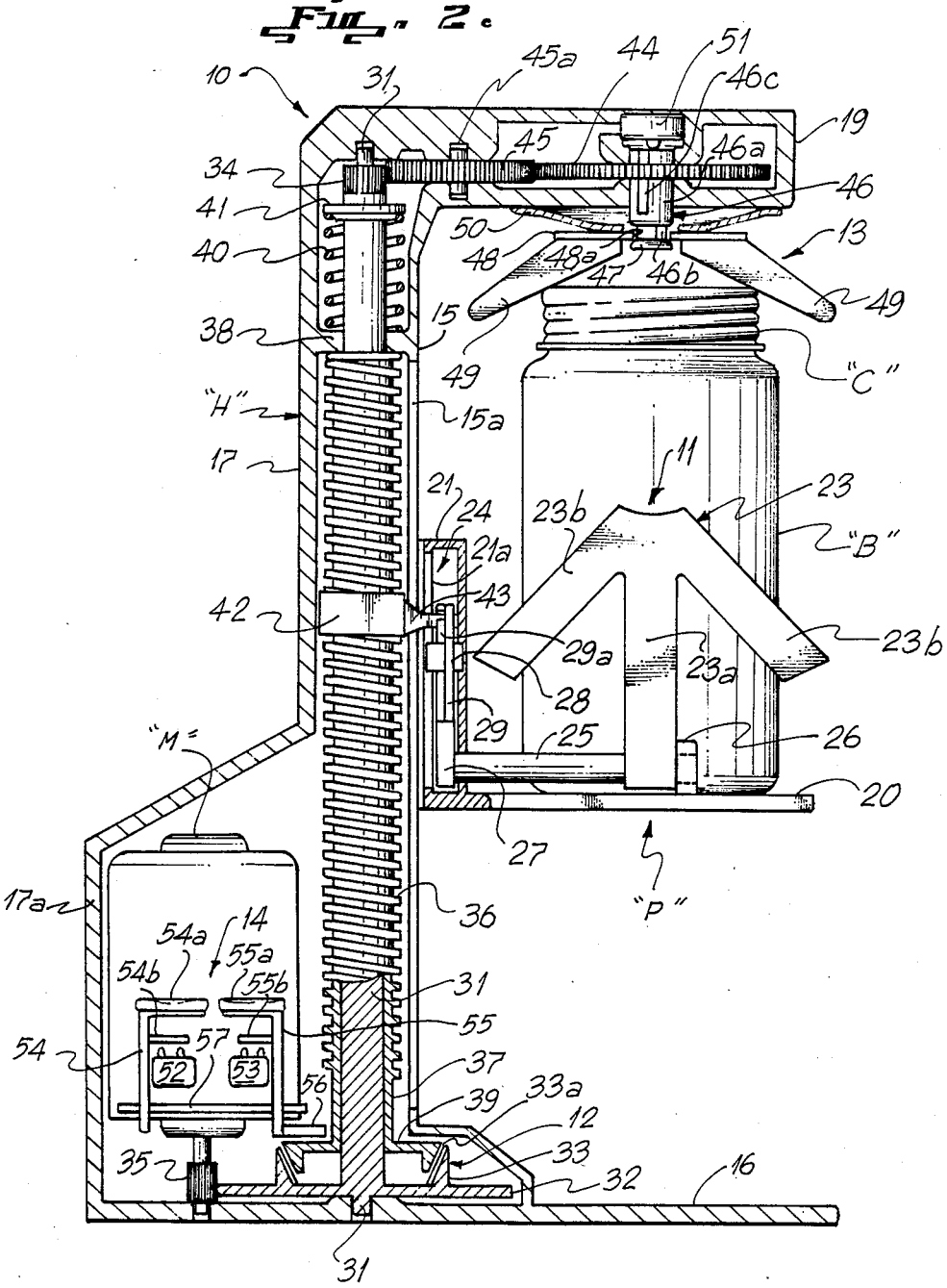
FIG. 2 is a vertical sectional view of FIG. 1 showing a large bottle being clamped thereon.

The bottle body clamping unit 11 (FIG. 3) comprises a pair of opposed identical bottle clamps 23, 23 each having a clamp stem 23*a* with a pair of downwardly diverging clamp arms 23*b* of V-shape formation, said bottle clamps being laterally disposed on said bottle seat 20, and a bottle clamping mechanism 24 operably held within the vertical case 21 (FIGS. 2, 4, 5). The lower ends of said clamp stems 23*a*, 23*a* are fixedly secured to the clamp shafts 25, 25.

The rear ends of said clamp shafts 25, 25 extend into vertical case 21 through its front wall, and the front ends of said clamp shafts are pivotally supported on shaft supports 26, 26. Fixedly secured at the rear ends of said shafts are identical sector-gear type clamp levers 27, 27*a*. Pivotally held within vertical case 21 on pivot pins 28, 28 are identical sector-gear type relay levers 29, 29*a*, the outer ends of which are provided with Slots 30, 30*a* with the gear teeth on the other ends meshing with the gear teeth of clamp levers 27, 27*a*. The relay levers 29, 29*a* are of predetermined length such that the relay lever slots 30, 30*a* when in superimposed relation with each other define a space coincident with the vertical case slit 21*a* from which a nut finger 43 freely projects.

The driving mechanism 12 comprises a vertical drive shaft 31 aligned with the elongated vertical housing slit 15*a* with its lower and upper ends journalled to base 16 and ceiling case 19. The lower end of said drive shaft is integrated with a large drive shaft gear 32 and a lower clutch member 33 with a clutch lining 33*a*, and the upper end of said shaft is provided with a drive shaft pinion 34. The drive shaft gear 32 is geared with the motor pinion 35 keyed on the shaft of the reversible motor "M".

A helically threaded hollow shaft 36 having a short unthreaded portion 37 at the lower end thereof is telescopically secured on drive shaft 31. The upper end of said threaded hollow shaft 36 abuts an annular shoulder 38 which is integrated with rear wall 17 and front panel 15 at a distance below the top end of drive shaft 31. Annular shoulder 38 provides a bushing and thus permits free rotation of drive shaft 31. Integrated therewith below said unthreaded portion 37 on drive shaft 31 is an upper clutch member 39 disposed in vertical coaxial alignment with the lower clutch member 33. A clutch spring 40 is supported on annular shoulder 38, said clutch spring being securely held by a clutch spring retainer 41 which freely rotates on a groove provided near the top end of drive shaft 31.

A screw nut 42 is screwably held on said threaded hollow shaft 36. Said screw nut moves up or down depending on the direction of the rotation of said threaded hollow shaft. As illustrated in FIG. 2, attached to the screw nut is a nut finger 43 which freely projects out of the elongated housing slit 15*a* of the housing front panel 15 into vertical case 21 through its vertical case slit 21*a*, and extends into the space formed by slots 30, 30*a* on relay levers 29, 29*a* which are in a superimposed relation with each other (FIG. 4). It is clearly shown that screw nut 42, together with the bottle platform "P", moves either up or down depending upon the direction of rotation (clockwise or counter clockwise) of threaded hollow shaft 36. When screw nut 42 has reached its lowest position which is on the unthreaded portion 37, said screw nut 42 together with bottle platform "P" becomes immobile. At this position, even if drive shaft 31 and threaded hollow shaft 36 continue to rotate either clockwise or counterclockwise, the bottle platform is at a standstill at its lowermost position.

The bottle cap loosener unit 13 is driven by a gear train rotatably supported within the ceiling case 19. Said gear train comprises a final gear 44 and an idler gear 45 which is rotatably supported on an idler shaft 45*a* and is in mesh with drive shaft pinion 34 and said final gear 44. Final gear 44 is rotatably keyed to a vertically slidable cap loosener pin 46 which is journalled for rotation on said ceiling case 19 and vertically aligned and coaxial with the center of the area between bottle clamps 23, 23. The cap loosener pin 46 is formed by an upper cylindrical portion 46*a* and a reduced square portion 46*b* having a lock 47. The cylindrical portion has a keyway 46*c* into which the key on said final gear is slidably held when said cap loosener pin slides up or down. At the reduced square portion 46*b* is suspendedly supported thereon a cap loosener unit 13, said unit consisting of a horizontal plate 48 and downwardly inclined loosener blades 49 being secured thereto. The horizontal plate has a centrally disposed square hole 48*a* loosely fitted on square portion 46*b* but the size of which is smaller than the cylindrical portion 46*a* and the thickness smaller than the height of said square portion 46*b* such that when the cap loosener unit 13 continues to rise, it pushes the cap loosener pin 46 at the lower end of the cylindrical portion 46*a*. The reduced square portion 46*b* onto which the cap loosener unit 13 loosely and freely hangs serves as a universal joint to transmit the rotating torque of final gear 44 to cap loosener unit 13, at the same time, to accommodate the off-centeredness or irregularities of the bottle cap "C". A diaphragm spring 50 having a center hole bigger than cylindrical portion 46*a* of the cap loosener pin is held underneath ceiling case 19 and bear against horizontal plate 48. A safety switch 51 is mounted within the ceiling case in close proximity with the top end of cap loosener pin 46, said switch adapted to stop motor "M" when the loosened bottle cap continues to rise.

The control switches 14 (FIG. 2) comprises an "Up" switch 53 and a "Down" switch 52 operably connected to the reversible motor "M" to drive the driving mechanism 12 for an "UP" or "DOWN" movement. The "down" switch 52 is actuated by a switch lever 54 having a switch knob 54*a* and an actuator 54*b*, and the "UP" switch 53 is actuated by a switch lever 55 (FIG. 6) having a switch knob 55*a*, an actuator 55*b* and a screw nut lifter 56, said switch lever 54 and switch lever 55 being pivotally supported by a common pivot pin 57. The screw nut lifter is normally positioned at the lower end of unthreaded lower portion 37 of hollow shaft 36, said nut lifter adapted to raise screw nut 42 and urge it to engage with threaded hollow shaft 36 for an upward movement, when switch lever 55 is pressed down.

A further embodiment of the bottle clamp mechanism employs clamp wires to move bottle clamps 23, 23 towards or away from each other as illustrated in FIGS. 7 and 7*a*. The bottle clamp mechanism 24*a* comprises clamp levers 58, 58*a* being fixedly secured at the rear ends of clamp shafts 25, 25, said clamp levers being normally held by clamp lever springs 59, 59*a* to urge said clamp levers at their farthest position from each other. Roller guides 40, 40*a* are rotatably held on the clamp case 21. Fixedly secured to the upper ends of clamp levers 58, 58*a* and to nut finger 43 of screw nut 42 are the clamp wires 61, 61 said clamp wires being guided on the roller guides.

As illustrated in FIG. 7, the clamp levers 58, 58*a* are farthest from each other when nut finger 43 of screw nut 42 is at its lowermost position. That is, the bottle platform is at a standstill at its lowermost position. In FIG. 7*a*, clamp levers 58 and 58*a* swing towards each other to their nearest position and the nut finger 43 is at its highest position to clamp bottle "B".

In the embodiment shown in FIG. 8, the improved bottle closure opener can be utilized to drive other appliances. As shown therein, a coupling 62 is incorporated to the shaft of the reversible motor "M" such that a blender cup 63 with blender blades 64 could be detachably coupled to coupling 42.

OPERATION (1) To bring down bottle platform "P", "Down" switch 52 is switched to "ON" position by manually pressing down switch knob 54*a* of switch lever 54. Motor "M", with motor pinion 35, drive shaft gear 32, lower clutch member 33 and drive shaft 31, begins to turn in "Down" direction. Since the lower end of clutch spring 40 is supported on annular shoulder 38, clutch spring 40 exerts upward pressure against clutch spring retainer 41 which, in turn, pushes drive shaft 31 to slightly slide upward until clutch lining 33*a* frictionally engages upper clutch member 39. Owing to this friction, threaded hollow shaft 36 now turns together with drive shaft 31, and, through the "Down" direction of the thread, forces screw nut 42 which is threadedly engaged with threaded hollow shaft 36 to move down. Nut finger 43 (FIG. 2),which is attached to screw nut 42 and extends into vertical case 21 where bottle clamp mechanism 24 is encased, also moves down along vertical case slit 21*a*, exerting pressure against the under sides of slots 30, 30*a* on sector gear type relay levers 29, 29*a*. Owing to said pressure the slot ends of relay levers 29, 29*a* to swing downward around relay lever Pin 28, 28, causing the sector gears on the gear ends of relay levers 29, 29*a* to swing away from each other. As the teeth on the sector gear of said relay levers 29, 29*a* are in gear with teeth of clamp levers 27, 27*a*, clamp levers 27 and 27*a* also swing away from each other (FIGS. 4, 5). This action, which is transmitted through clamp shaft 25, 25, causes two bottle clamps 23, 23 to also swing away from each other, and opens up the space between said bottle clamps.

As nut finger 43 reaches the bottom of vertical case slit 21*a* (FIG. 5), it now presses directly upon bottle platform "P", forcing it to slide downward along guide grooves 18*a* of housing "H". When bottle platform "P" reaches its lower terminal, nut finger 43 together with screw nut 42 also reaches unthreaded portion 37 of threaded hollow shaft 36, leaving screw nut 42 immobile in that position even as motor "M" and the driving mechanism continue rotating Nut finger 43 has reached its lowest position and the pair of clamp arms 23*b*, 23*b* of bottle clamps 23, 23 are at their farthest position from each other (FIG. 5*a*). Now, a bottle "B" is positioned on bottle seat 20 between bottle clamp arms 23, 23 and is ready to be clamped.

(2) To bring up bottle platform "P" with the bottle to be opened being positioned thereon, the "Up" switch 53 is switched to "On" position by manually pressing down switch knob 55*a* of switch lever 55. Motor "M" and driving mechanism 12 begin to rotate in a direction reverse to the rotation of said motor and driving mechanism when bottle platform "P" was brought down. By further pressing down switch knob 55*a*, screw nut lifter 56, which is at the other side of pivot pin 57, rises, causing the immobile screw nut 42 to rise and engage itself with the threads of the rotating threaded hollow shaft 36, and to be propelled all the way up the rotating threaded hollow shaft 36. Since guide blocks 22 of vertical case 21 of bottle platform "P" are in a rather tight-fit relation with guide grooves 18*a* of housing "H", the upward movement of screw nut 42 and the attached nut finger 43 do not immediately push up the bottle platform. Instead, the nut finger pushes up sector gear type relay levers 29, 29*a* on slots 30, 30*a* causing geared ends of relay levers 29, 29*a* and clamp levers 27, 27*a* to sway towards each other, thus, clamp arms 23*b*, 23*b* move toward each other and, by means of V-shape formation, hold bottle "B" into the center of platform "P", and clamp it in between clamp arms 23*b*, 23*b*. When clamp arms 23*b*, 23*b* have attained its full grip on the bottle and relay levers 29, 29*a* can no longer move around relay levers 29, 29*a*, the upward drive of nut finger 43 now bears on the whole platform "P" and forces it to move up along the guide grooves 18, 18*a*. When the bottle cap "C" reaches loosener blade 49, bottle platform "P" stops moving up. But, since "Up" switch knob 55*a* is still been pressed and motor "M" still rotating, screw nut 42 and nut finger 43 keep pushing up, exerting additional upward force on relay lever slots 30, 30*a* that act both on clamp arms 23*b*, 23*b* to further clamp tightly on the bottle body of bottle "B", and on platform "P" to press bottle cap "C" firmer up against loosener blades 49.

(3) Now all elements are taut and screw nut 42 has met its ultimate resistance and stops moving up. This inhibits threaded hollow shaft 31 from turning, thus, upper clutch member 39 also stops. Since motor "M" is still turning, the torque on lower clutch member 33 now overcomes the friction between clutch lining 33*a* and upper clutch member 39, and begins to slip against the immobile upper clutch member 39. Said slip allows drive shaft 31 to continue turning while maintaining the clamping stress of clamp arms 23*b*, 23*b* against bottle "B" as well as the upward pressure of bottle cap "C" against loosener blade 49. As switch knob 55*a* of "UP" switch 53 is still being pressed, final gear 44 turns in corresponding "open" direction (viewed from above, counterclockwise). Since cap loosener pin 46 is keyed to final gear 44, it also turns in "open" direction. The bottle cap loosener unit 13 freely hangs on the reduced square portion 46*b* of cap loosener pin 46 such that it serves as a universal joint to accommodate certain amount of irregularities or off-centeredness of bottle cap "C" so that all opener blades contact and press evenly on the bottle cap. With bottle cap loosener unit 13 driven by the cap loosener pin 46 at the reduced square portion 46*b*, cap loosener unit 13 then twist loose bottle cap "C" from the bottle.

When the bottle cap is turned loose, release switch knob 55*a* of "UP" switch 53 to stop the motor and the cap loosener unit. If, as in some cases, "UP" switch knob 55*a* is not released even if bottle cap "C" has already been turned loose, motor "M" will keep on turning and cap loosener unit 13 will continue to turn loose the bottle cap. This continuing loosening of bottle cap causes the cap to substantially rise up from the bottle mouth. Since the space between platform "P" and cap loosener unit 13 is not expandable, the rising bottle cap creates additional stress on cap loosener unit 13, platform "P", as well as the glass body of bottle "B", and might have ill effects on these components. In this case, the additional stress will press cap loosener unit 13 upward, causing cap loosener pin 46 to slide upward in the ceiling case 19 as well as in the center hole of final gear 44. Cap loosener unit 13 then compresses diaphragm spring 50, causing it to move upward till the top of loosener pin 46 pushes the trigger of safety switch 51 to cut off the current flow to the motor. Thus, cap loosener unit 13 stops turning. The strength or rate of the diaphragm spring is predetermined such that at normal operation the diaphragm spring can resist the upward thrust of bottle cap "C" against the cap loosener unit 13, while, when bottle cap has risen excessively and begins to cause abnormal stress, it will be compressed and allow cap loosener pin 46 to slide upward to actuate safety switch 51 to stop motor "M".

To release bottle "B", press down switch knob 54*a* of "Down" switch 52. Motor "M" rotates to bring down nut finger 43 to open up clamp arms 23*b*, 23*b* and release bottle "B" and then bring down platform "P" to extricate bottle cap from loosener blades 49. As platform "P" moves down, diaphragm 50 returns to its original form, bringing down loosener pin 46, thus releases the trigger of safety switch 51. If "down" switch knob 54*a* is pressed all the way, platform "P" will go down to the bottom till screw nut 42 settles at the unthreaded portion 37 and stays there. Motor "M" will go on turning, causing the whole drive mechanism unit to turn with it but will not be subjected to working load. Thus, motor "M" can be utilized for other appliances such as a blender, a can opener, and the like.

FIG. 8 shows an example where motor "M" is used to drive a blender cup 63 when screw nut 42 is at the unthreaded portion 37 and motor "M" is not subjected to working load from the bottle closure opener

We claim:

1. A bottle closure opener for use in screw type bottle caps comprising:

(a) a housing having a front panel provided with an elongated vertical opening disposed at the mid-section thereof, a rear wall disposed proximate said front wall, opposed side walls with vertical grooves disposed at the outer surfaces thereof, a base, and a ceiling case;

(b) a bottle platform having an L-shape body formed by a bottle seat and a vertical case provided with vertical guide blocks adapted to be slidably held on the vertical grooves of said walls, said vertical case having a vertical slit disposed at the mid-section thereof and aligned with the elongated vertical opening on said front panel;

(c) a bottle body clamping unit comprising a pair of opposed identical bottle clamps of V-shape formation laterally disposed on said bottle seat, the lower ends of each of said bottle clamps being fixedly secured on a clamp shaft extending to the inside of said vertical case, a bottle clamping mechanism being operably held and concealed within said vertical case, said mechanism comprising identical sector-gear type clamp levers fixedly secured at the rear ends of said clamp shafts, identical sector-gear type relay levers pivotally held on said vertical case, the gear teeth of said relay levers meshing with the gear teeth of said clamp levers, and the outer ends of said relay levers provided with slots disposed in a superimposed relation with each other to define a space coincident with the vertical slit on said vertical case;

(d) a driving mechanism consisting of a vertical drive shaft journalled for rotation at the rear end of and aligned with the elongated vertical opening of said front panel, said drive shaft provided with a drive shaft gear integrated with a lower clutch member having a clutch lining at its lower end and drivingly connected to a reversible motor, and a drive pinion gear at its upper end thereof, a helically threaded hollow shaft having an unthreaded lower portion telescopically received on said drive shaft, the upper end of which abuts an annular shoulder disposed at a distance below the top end of said drive shaft, an upper clutch member integrated at the lower end of said unthreaded portion in vertical alignment with said lower clutch member, a clutch spring provided at the upper end of said drive shaft, a screw nut screwably engage on said threaded hollow shaft, said screw nut having an attached nut finger extending through the vertical slit on said vertical case of said bottle platform;

(e) a bottle cap opener unit driven by a gear train supported within said ceiling case and having its final gear drivingly connected to said drive shaft, said final gear being rotatably keyed to a vertically slidably cap opener pin having a reduced lower square portion and coaxially aligned with the center between said bottle clamps, and cap opener blades suspendedly supported on said reduced square portion; and (f) control switches comprising a "down" switch and an "up" switch operably connected to a reversible motor, said "down" switch being actuated by a switch arm to drive said driving mechanism to move down said screw nut and bottle platform, and said "up" switch being actuated by switch lever having a screw nut lifter normally positioned at the lower end of the unthreaded portion of said hollow shaft to raise said screw nut to move up said screw nut and bottle platform.

2. A bottle closure opener in accordance with claim 1 further comprising a diaphragm spring disposed at the bottom of said ceiling case to bear against said opener blades, and a safety switch provided above the opener pin whereby bottom cap opener unit stops rotation when said switch is actuated by said pin upon loosening of the bottle cap.

3. A bottle closure opener in accordance with claim 1 wherein said bottle clamp mechanism employ wires connected to said clamp levers fixedly secured to the clamp shafts and to the nut finger guided by rollers to move the bottle clamps towards or away from each other

4. A bottle closure opener in accordance with claim 1 wherein an appliance coupling is provided on the other end of the reversible motor adapted to drive other appliances when said screw nut is positioned on the unthreaded lower portion of said hollow shaft.

* * * * *